US005890288A

United States Patent [19]

Rhodes et al.

[11] Patent Number: 5,890,288

[45] Date of Patent: Apr. 6, 1999

[54] METHOD FOR MAKING A HEAT EXCHANGER TUBE

[75] Inventors: Eugene E. Rhodes, Belleville; Greg Whitlow, Whitmore Lake; Wen Fei Yu, West Bloomfield, all of Mich.

[73] Assignee: Ford Motor Company, Dearborn, Mich.

[21] Appl. No.: 916,192

[22] Filed: Aug. 21, 1997

[51] Int. Cl.[6] ..... B23P 15/26

[52] U.S. Cl. ..... 29/890.053; 29/890.054

[58] Field of Search ..... 29/890.053, 890.054; 165/183

[56] References Cited

U.S. PATENT DOCUMENTS

| | | |
|---|---|---|
| 349,060 | 9/1886 | Serve . |
| 438,025 | 10/1890 | Serve . |
| 2,655,181 | 10/1953 | Cooper . |
| 3,906,605 | 9/1975 | McLain . |
| 4,360,958 | 11/1982 | Kritzer . |
| 5,036,909 | 8/1991 | Whitehead et al. . |
| 5,172,476 | 12/1992 | Joshi . |
| 5,185,925 | 2/1993 | Ryan et al. . |
| 5,186,250 | 2/1993 | Ouchi et al. . |
| 5,271,151 | 12/1993 | Wallis . |
| 5,386,629 | 2/1995 | Ouchi et al. . |
| 5,476,141 | 12/1995 | Tanaka . |
| 5,482,112 | 1/1996 | Sasaki et al. . |
| 5,553,377 | 9/1996 | Hirano et al. . |
| 5,560,425 | 10/1996 | Sugawara et al. . |
| 5,579,837 | 12/1996 | Yu et al. . |

FOREIGN PATENT DOCUMENTS

| | | |
|---|---|---|
| 872895 | 4/1953 | Germany . |
| 3615300 | 11/1987 | Germany . |
| 4103767 | 8/1992 | Germany . |
| 56-148415 | 11/1981 | Japan . |
| 57-44420 | 3/1982 | Japan . |
| 63-242432 | 3/1987 | Japan . |
| 6-123571 | 5/1994 | Japan . |
| 1518043 | 10/1989 | Russian Federation . |
| 332280 | 7/1930 | United Kingdom . |
| 1390781 | 4/1975 | United Kingdom . |

*Primary Examiner*—Irene Cuda
*Attorney, Agent, or Firm*—Raymond L. Coppiellie

[57] ABSTRACT

A method for making a heat exchanger tube having an elongated, generally rectangular member including a planar base, a top, and pair of arcuate opposed side portions interposed between the base and the top. A partition extends from the top to the base to define a pair of fluid passageways, the partition including a pair of opposing, contacting shoulder portions and a leg portion depending from each of the shoulder portions which contact the base. A first braze receiving of predetermined size is defined between the shoulder portions and the manifold of the heat exchanger. The size of the braze receiving area is controlled by minimizing the curvature of the shoulder portions.

6 Claims, 3 Drawing Sheets

METHOD FOR MAKING A HEAT EXCHANGER TUBE

RELATED APPLICATIONS

This application is related to commonly assigned U.S. patent application, attorney docket no. 196-1190, titled: "HEAT EXCHANGER", filed on even date herewith.

FIELD OF THE INVENTION

The present invention relates generally to heat exchanger tubes. More particularly, the present invention relates to heat exchanger tubes for use in an automotive vehicle and a method for making the same.

DISCLOSURE INFORMATION

Heat exchangers employ a wide variety of tube geometries depending upon the heat transfer characteristics needed to be achieved. For example, U.S. Pat. No. 5,381,600 discloses a condenser for an automotive vehicle using round tubes having an internal surface with corrugation-like teeth formed thereon. Other heat exchanger designs use different types of tubes. A second example can be found in air conditioning system condensers of the parallel flow type. In this type of condenser, substantially flat refrigerant tubes are used. These tubes must withstand high pressure gaseous refrigerant which flows through them and still achieve high heat transfer characteristics. As is well known, these flat tubes have a plurality of discrete flow paths formed therein. The flow paths can be formed by inserting an undulating metal insert into the tube and brazing the insert into place. The flow paths can also be formed by forming walls in the tube during an extrusion process.

It is also known to provide a corrugated fin or rib in the interior of a heat exchanger tube to increase the surface area of conductive material available for heat transfer, to cause turbulence of the fluid carried in the interior of the tube and to increase the burst strength of the tube. One known method of creating such a tube is to physically insert a corrugated fin into the generally flattened tube after the tube has been manufactured. This is an extremely difficult process since the corrugated fin to be inserted into the tube is extremely thin and subject to deformation during the insertion process.

U.S. Pat. No. 5,579,837, assigned to the assignee of the present invention, discloses another flat tube design particularly useful in automotive radiators. The tube is formed by rolling the outermost longitudinal ends of a planar sheet of material toward one another at a centerline of the sheet. The ends are folded so as to form shoulders. The shoulders then come together at the centerline to define a weld seam on one flat face of the tube as well as a partition extending the longitudinal length of the tube between the top and bottom sides of the tube. The shoulders have a radius of curvature which causes the shoulders to be spaced away from one another by a distance. This distance is filled with braze material during the fabrication of the tube. Although this design performs well in service, it has been found that the strength of the tube can be increased by minimizing the distance between these shoulders and utilizing less braze material between them. Therefore, it would be advantageous to provide a tube which is capable of withstanding high internal fluid pressures and which is reliable and easy to fabricate.

SUMMARY OF THE INVENTION

The present invention solves the problems associated with the prior art by providing a method of forming a tube for a heat exchanger, comprising the steps of: providing a sheet of elongate, deformable material having a longitudinal axis and a transverse axis which define a longitudinal centerline, the sheet defining a generally planar base and a pair of terminal edges along the longitudinal length thereof, and coating one side of the sheet with a braze material. The method further includes forming a pair of folded-over leg portions by folding each of the terminal edges along their longitudinal length towards the longitudinal centerline of the sheet a predetermined distance and bending each of the folded-over leg portions generally perpendicular to the plane of the sheet so as to define a shoulder portion having a first radius at each. Next, the radius of curvature of each shoulder portion is minimized each of the leg portions are folded toward one another until the shoulder portions contact one another at the longitudinal centerline of the sheet so as to form a pair of generally arcuate tube side portions and a tube top portion, the braze material being on an outer surface of the side and top portions. The method further includes the steps of forming a pair of fluid passageways by bending the leg portions inwardly toward the base at an acute angle until each leg portion contacts the base while keeping the shoulder portions in contact with one another, this step also including forming a first braze material receiving area between the leg portions and coating an outside surface of the fluid passageways with a brazing flux. The fluid passageways are heated at a predetermined temperature to melt the braze material, the flux causing the braze material to flow by capillary flow into the first braze material receiving area and substantially filling the area. The fluid passageways are cooled to solidify the molten braze material to secure the fluid passageways to one another and to secure the leg portions to the base at a predetermined angle to form the heat exchanger tube. In one embodiment, the step of minimizing the radius of curvature of each of the shoulder portions includes the step of forming a substantially right angle between the planar base of the sheet and each folded-over leg portion by applying a vertical compressing load against each of the folded-over leg portions in a die.

By controlling the width of the braze seam, an increased tube strength is achievable. These and other objects, features and advantages of the present invention will become apparent from the drawings, detailed description, and claims which follow.

DETAILED DESCRIPTION OF THE PREFERRED EMBODIMENTS

Figure 1:
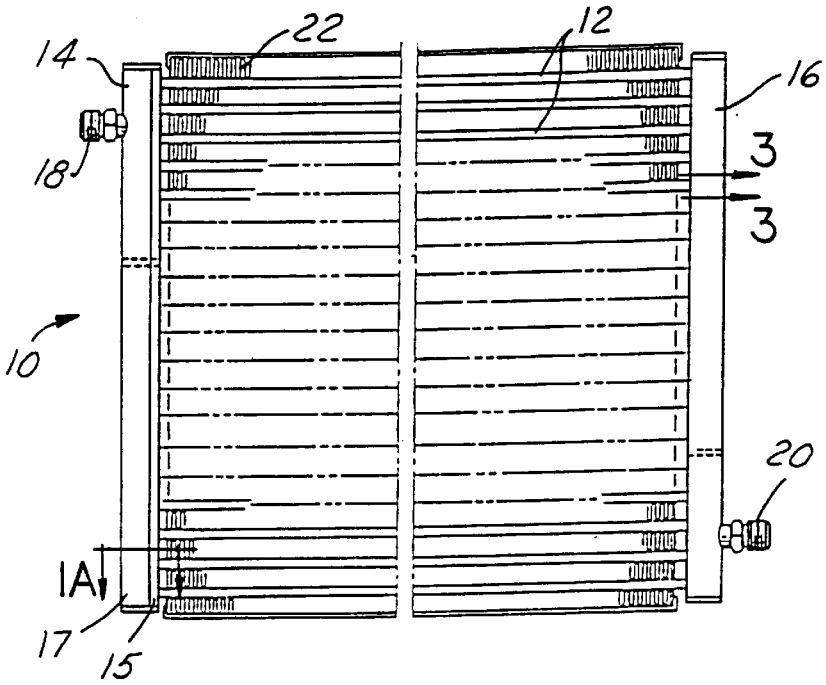
FIG. 1 is a perspective view of a heat exchanger for an automotive vehicle utilizing a heat exchanger tube of the present invention.
Figure 1A:
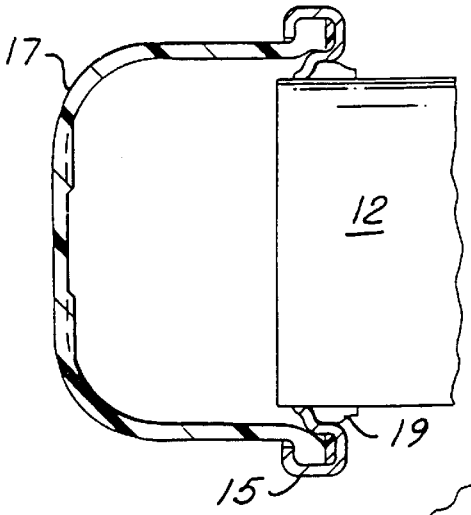
FIG. 1A is an enlarged view of a portion of a heat exchanger for an automotive vehicle utilizing a heat exchanger tube of the present invention.

Referring now to the drawings, FIG. 1 shows a heat exchanger 10 for use in automotive applications, such as radiator or a condenser. The heat exchanger includes a set of generally parallel tubes 12 extending between oppositely disposed manifolds 14, 16. The manifolds 14, 16 may either be fabricated as a single tubular element or may be formed as a two-piece member, having a header plate 15 secured to a fluid tank 17 as is well known in the art and shown in FIG. 1A. The manifolds each include a plurality of tube receiving slots. In the header/tank embodiment, the tube receiving slots are circumferentially surrounded by a raised ferrule 17. A fluid inlet 18 for conducting cooling fluid into the exchanger 10 is formed in the manifold 14 and an outlet 20 for directing fluid out the heat exchanger 10 is formed in the manifold 16. Convoluted or serpentine fins 22 are attached exterior of each of the tubes 12 and serve as a means for conducting heat away from the tubes 12 while providing additional surface area for convective heat transfer by air flowing over the heat exchanger 10. The fins 22 are disposed between each of the tubes 12 of the heat exchanger 10.

Figure 2:
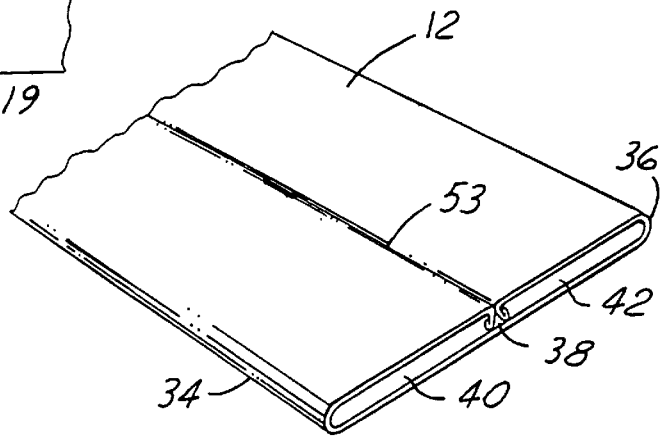
FIG. 2 is a perspective view of a heat exchanger tube of the present invention.
Figure 3:
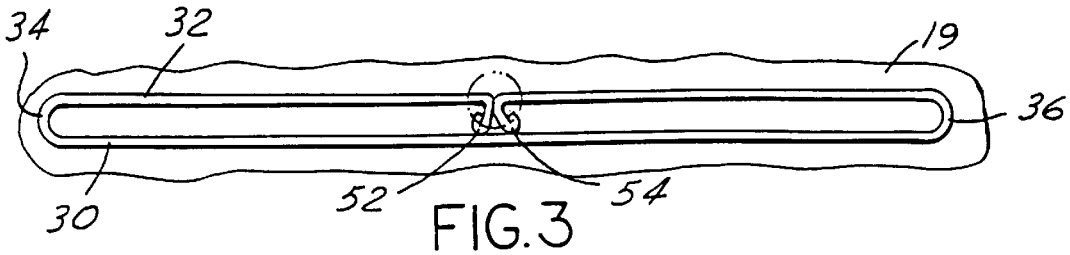
FIG. 3 is a cross sectional view taken along line 3—3 of the heat exchanger tube of FIG. 2.

FIGS. 2–4 show a detailed illustration of one of the tubes 12 of the heat exchanger 10 of FIG. 1. The tube 12 is substantially flat as viewed in crosssection and includes a generally planar base 30, a top side 32 and a pair of generally arcuate, opposed side portions 34, 36 interposed between base 30 and the top side 32. As such, the tube 12 is generally rectangularly- or oblong-shaped. The tube further includes a partition 38 extending from the top side 32 to the base 30 and which defines a pair of adjacent of elongates fluid passageways 40, 42. The partition 38 includes a pair of opposing, contacting shoulder portions 44, 46 disposed at a predetermined radius of curvature toward one another. Each of the shoulder portions 44, 46 includes a first outer segment 45, 47 and a leg portion 48, 50 respectively, depending from each of the shoulder portions 44, 46 and which contact the base 30 at terminal ends 52, 54 respectively. A braze seam 53 is disposed at the top of the partition along the longitudinal length of the tube 12.

Figure 4A:
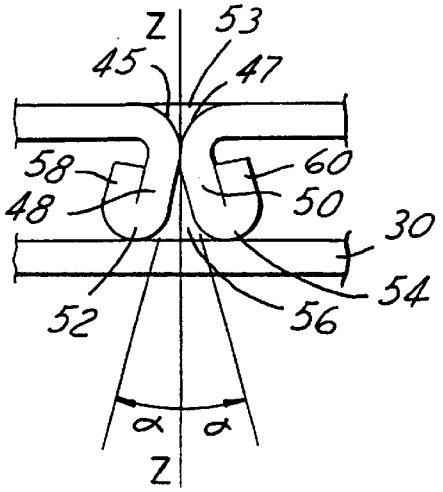
FIGS. 4A and 4B are enlarged views of a portion of the tube of FIG. 3.
Figure 4B:
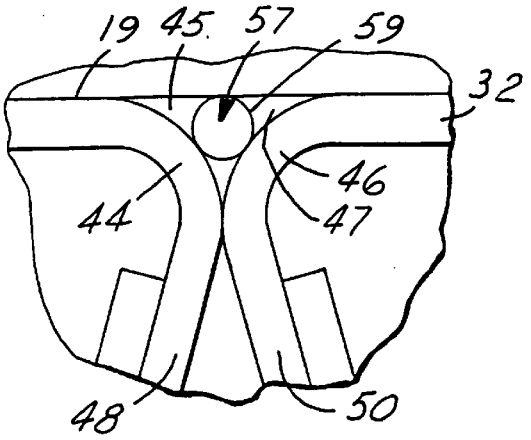
Figure 5:
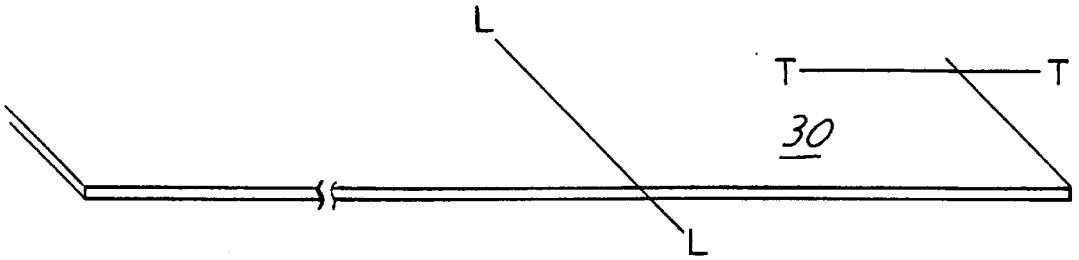
FIGS. 5–11 illustrate the steps of the method of forming a tube according the present invention.
Figure 6:
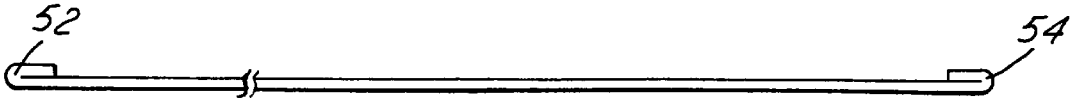

As can be further seen in greater detail in FIG. 4B in which the tube 12 is shown as placed within a tube receiving slot surrounded by ferrule 19, a braze receiving area 57 is formed between shoulder portions 44, 46 and ferrule 19. More specifically, in the plane of the cross-section as illustrated in FIG. 4 (transverse to the longitudinal axis of the tube 12), the braze receiving area 57 can be described by a circle 59. The circle 59 is tangent to each of the first outer segments 45, 47 of the shoulder portions 44, 46, respectively, and the ferrule 19 (or manifold tube receiving slot if no ferrule is present). In the preferred embodiment of the present invention, the maximum diameter of the circle 59 is between 0.005 in and 0.010 in and preferably 0.008 in. By defining the braze receiving area 57 in terms of the circle 59, manufacturing tolerances can be more easily checked and met. This dimension is controlled by the exterior and interior radii of curvature of the shoulder portions 44, 46. To achieve the maximum diameter of circle 59 between 0.005 in and 0.010 in, the outer (exterior) radius of curvature of each shoulder portion is between 0.006 in and 0.015 in while the interior radius of curvature lies between 0.002 in and 0.008 in. In contrast, the radii of curvature for the embodiments described in U.S. Pat. No. 5,579,837, assigned to the assignee of the present invention are much larger: the outer radius lies between 0.025 in and 0.030 in while the interior radius is between 0.005 and 0.010 in. These dimensions form a braze receiving area 57 or circle 59 with an outer diameter of greater than 0.012 in. It is difficult to form the shoulder portions 44, 46 to any smaller radius than what is disclosed herein due to the formability of the material used to fabricate the tube 12.

Referring back to FIG. 4A, each of the leg portions 48, 50 is disposed at a predetermined angle, $\alpha$ relative to a vertical plane (designated by line Z—Z) perpendicular to the plane of the base 30. This angle, $\alpha$, can range between five and fifteen degrees and in the preferred embodiment is ten degrees. Furthermore, the terminal ends 52, 54 of the leg portions 48, 50, respectively, are spaced apart a predetermined distance on the order of between 0.010–0.030 inches. As viewed through a cross-sectional plane as shown in FIG. 4, the area between the partition 38 and the terminal ends 52, 54 define a second braze receiving area, or fillet 56 of predetermined area. This area can be between 0.108 to 0.235 mm square and provides for additional brazing strength. In this embodiment, the leg portions 48, 50 are not only secured together along partition 38 but are secured to the base portion 30 by the fillet 56. As such, more surface area of the partition and leg portion are connected to the base, thus increasing the overall burst strength of the tube 12. To further increase the strength of the tube, the leg portions 48, 50 at the terminal ends 52, 54 of the tube may include a bent over portion 58, 60. The bent over portions ensure a good braze connection of the leg portions 48, 50 to the base 30.

As will be explained in greater detail below the outer surface of the tube is coated with a known brazing material and the brazing material flows into the braze material receiving fillet 56 through the partition 38 by capillary flow action.

The tube 12 of the present invention is manufactured and according with the following steps as shown subsequently in FIGS. 5–11. Like elements have been given like reference numerals to ease in the understanding of the method of manufacturing a tube according to the present invention. The forming steps will be described in a roll forming operation, but other known tube manufacturing techniques can be used as well. Beginning with FIG. 5, a generally planar sheet of elongate, deformable material 30 is provided which has a longitudinal axis designated by line L—L and a transverse axis designated by T—T. The sheet has a generally planar base 30 and pair of terminal edges 52,54 along the longitudinal length of the sheet. One side of the sheet is coated with a braze material which is commercially available and well known to those skilled in the art. The terminal edges 52, 54 of the sheet can either be flat or can include a bent over portion 58, 60 as shown in the preferred embodiment of FIG. 6. The bent over portion is formed first by simply rolling the outboard terminal edges of the planar sheet toward the longitudinal centerline of the sheet.

Figure 7:
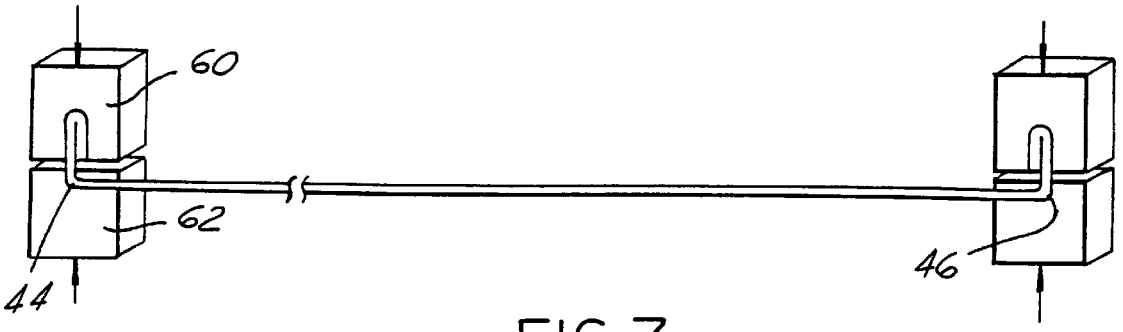

The shoulder portions are formed next (FIG. 7). The bent-over edges 52, 54 are folded generally perpendicularly to the plane of the sheet 30 to form the leg portions 48, 50. The shoulder portions 44, 46 are the transition area between the leg portions 48, 50 and the top 32 of the tube. To minimize the radius of curvature of each shoulder portion, the shoulder portions 44, 46 are inserted into a set of upper and lower roll dies 60, 62, respectively. The dies are then subjected to a compressive force (as shown by the arrows) to force the terminal edges 52, 54 toward the bottom of the planar sheet 30. This causes an almost right angle to be formed between the leg portions 48, 50 and the tube bottom 30, thus forming the shoulder portions as described above.

Figure 8:
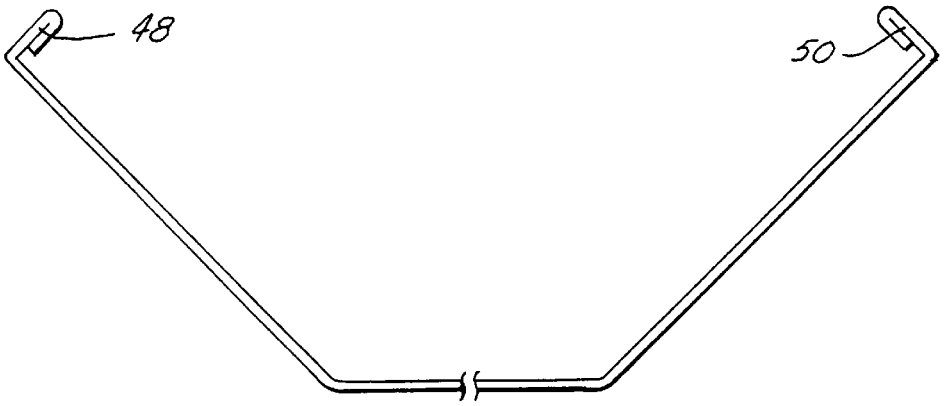
Figure 9:
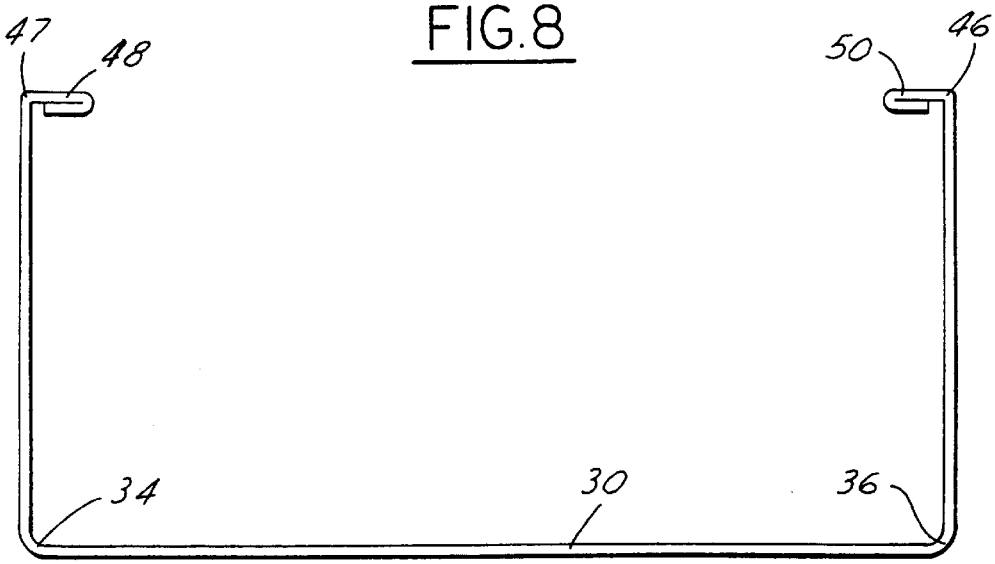
Figure 10:
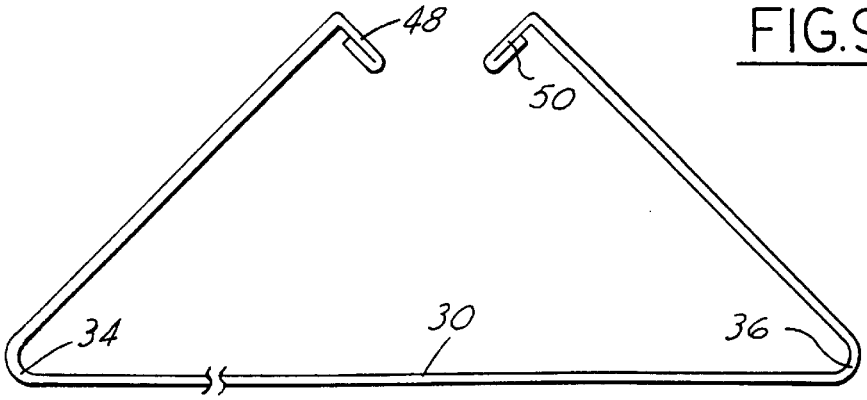
Figure 11:
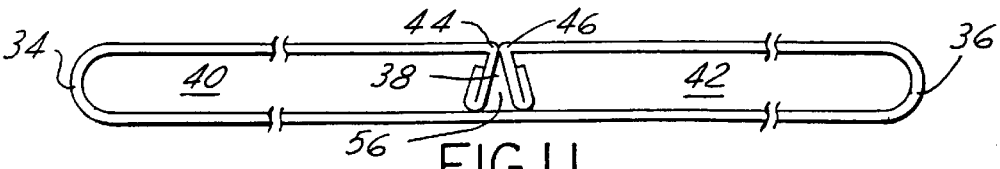

Following this step, as shown in FIGS. 8, 9, each of the shoulder portions 44, 46 is folded toward one another until they meet in the longitudinal center of the sheet. In doing so, a pair of generally arcuate side portions 34, 36 are formed as is the top portion 32. In this step, the braze material is found on an outer surface of the top and side portions of the tube to be manufactured. Following this step, a pair of fluid passageways, 40, 42 are formed by bending the terminal edges 52, 54 inwardly toward the base at an acute angle relative to a vertical plane perpendicular to the base as explained above. The terminal edges 52, 54 are bent inwardly until each of the edges contact the base 30 so as to form the braze material receiving fillet area 56 between the terminal edges 52, 54.

Next, the outside of the tubular member and fluid passageways are coated with a brazing flux material as is commonly known in the art. The tubular assembly is then heated at a predetermined temperature to melt the brazing material, the brazing flux causing the braze material to flow by capillary flow into the first braze receiving area 53 and the second braze receiving fillet area 56 and substantially filling the entire area. The assembly is then cooled to solidify the molten braze material in the fillet area 56 to secure the leg portions 48, 50 and terminal edges 56, 58 to the base 30 to form the heat exchanger tube. As such, a braze seam 53 is formed along the top of the partition along the entire longitudinal length of the tube. As previously explained above, the acute angle formed by the terminal edges and the vertical plane can be between 10 and 20 degrees as with a preferred design being 15 degrees. By forming the leg portions with this radius of curvature, increased burst strength is achieved.

Various modifications and alterations of the present invention will no doubt occur to those of skill in the art. For example, another method of minimizing the radius of curvature at each shoulder portion 44, 46 is to score a line into the sheet of material 30 along its entire longitudinal length at the location where the shoulder is to be formed. The groove has a predetermined depth which locally reduces the thickness of the sheet material, allowing a tighter radius to be formed. Also, a bridging punch can be used after the tube is formed to flatten the tube, forcing the shoulders closer together. Therefore, it is the following claims, including all equivalents which define the scope of the present invention.

What is claimed is:

1. A method of forming a tube for a heat exchanger, comprising the steps of:

providing a sheet of elongate, deformable material having a longitudinal axis and a transverse axis which define a longitudinal centerline, the sheet defining a generally planar base and a pair of terminal edges along the longitudinal length thereof, and one side of the sheet being coated with a braze material;

forming a pair of folded-over leg portions by folding each of the terminal edges along their longitudinal length towards the longitudinal centerline of the sheet a predetermined distance;

bending each of the folded-over leg portions generally perpendicular to the plane of the sheet so as to define a shoulder portion having a first radius at each;

minimizing the radius of curvature of each shoulder portion by forming a substantially right angle between the planar base of the sheet and each folded-over leg portion by applying a vertical compressing load against each of the folded-over leg portions in a die;

folding each of the leg portions toward one another until the shoulder portions contact one another at the longitudinal centerline of the sheet and forming a pair of generally arcuate tube side portions and a tube top portion, the braze material being on an outer surface of the side and top portions;

forming a pair of fluid passageways by bending the leg portions inwardly toward the base at an acute angle until each leg portion contacts the base while keeping the shoulder portions in contact with one another, the step also including forming a first braze material receiving area between the leg portions;

coating an outside surface of the fluid passageways with a brazing flux;

heating the fluid passageways at a predetermined temperature to melt the braze material, the flux causing the braze material to flow by capillary flow into the first braze material receiving area and substantially filling the area;

cooling the fluid passageways to solidify the molten braze material to secure the fluid passageways to one another and to secure the leg portions to the base at a predetermined angle to form the heat exchanger tube.

2. The method according to claim 1, wherein the step of minimizing the radius of curvature of each of the shoulder portions further includes the step of forming the shoulder portions to have a radius of curvature of between 0.003 in to 0.020 in.

3. The method according to claim 1, wherein the step of forming a pair of fluid passageways by bending the leg portions at an acute angle further includes bending the leg portions to form a braze seam comprising a pair of generally squared portions disposed along the longitudinal length of the sheet of material.

4. The method according to claim 1, wherein the step of forming a pair of fluid passageways by bending the leg portions at an acute angle further includes bending the leg portions so as to form an angle of between 5 to 15 degrees relative to a vertical plane perpendicular to the base of the sheet of material.

5. The method according to claim 1, wherein the step of forming a first braze receiving area further includes forming the braze receiving area to a cross-sectional area of 0.100 to 0.240 square mm relative to a vertical plane perpendicular to the plane of the base.

6. The method according to claim 1, wherein the step of cooling the fluid passageways to solidify the molten braze further includes securing one leg portion to the other with the braze material.

* * * * *